US007140307B1

(12) United States Patent
Wolbert

(10) Patent No.: US 7,140,307 B1
(45) Date of Patent: Nov. 28, 2006

(54) DISPLAY BOOTH FRAMEWORK

(75) Inventor: Paul A Wolbert, Grand Rapids, MI (US)

(73) Assignee: Paul Wolbert, L.L.C., Grand Rapids, MI (US)

( * ) Notice: Subject to any disclaimer, the term of this patent is extended or adjusted under 35 U.S.C. 154(b) by 415 days.

(21) Appl. No.: 10/767,100

(22) Filed: Jan. 29, 2004

Related U.S. Application Data

(60) Provisional application No. 60/445,935, filed on Feb. 7, 2003.

(51) Int. Cl.
*A47B 13/00* (2006.01)

(52) U.S. Cl. ..... 108/153.1; 108/180; 108/193

(58) Field of Classification Search ..... 108/153.1, 108/154, 156, 180, 184, 185, 157.1, 157.16, 108/157.18, 157.12, 50.01, 183, 193, 192, 108/165; 312/223.6, 223.1, 223.3; 211/187, 211/49.1
See application file for complete search history.

(56) References Cited

U.S. PATENT DOCUMENTS 2,750,050 A * 6/1956 Ludwig ..... 211/49.1
3,176,419 A * 4/1965 Stein ..... 40/610
3,532,310 A * 10/1970 Finfrock ..... 248/535
3,877,396 A * 4/1975 Patterson ..... 108/183
4,078,690 A * 3/1978 Goettl ..... 220/62
4,102,276 A * 7/1978 Roveroni ..... 108/156
4,102,525 A * 7/1978 Albano ..... 108/51.3
4,351,246 A * 9/1982 Hutchins, Jr. ..... 108/156
4,638,745 A * 1/1987 Sheffer ..... 108/192
4,699,067 A * 10/1987 Okopny ..... 108/186
4,740,032 A * 4/1988 Olsen et al. ..... 108/180
4,879,800 A * 11/1989 Rumman ..... 108/156
4,941,412 A * 7/1990 Engel ..... 108/156
5,463,966 A * 11/1995 Nilsson ..... 108/110
6,101,954 A * 8/2000 Rein et al. ..... 108/50.02
6,769,747 B1 * 8/2004 Chan et al. ..... 108/157.16
6,920,831 B1 * 7/2005 Lin ..... 108/107

* cited by examiner

*Primary Examiner*—Jose V. Chen
(74) *Attorney, Agent, or Firm*—Van Dyke, Gardner, Linn & Burkhart, LLP

(57) ABSTRACT

A framework for a display booth includes at least one base, at least one post, at least one beam and a connector. The post is adapted to be releasably attached to the base and to extend vertically upward from the base when attached thereto. The post includes at least two panels pivotally secured together. The beam is adapted to be releasably attached to the post and includes at least two panels pivotally secured together. The connector is adapted to be releasably attached to both the post and the beam. The connector is adapted to support the beam on the post when the connector is connected to both the post and the beam. The post and the beam may be folded to a folded orientation to ease transportation and storage of the framework when it is not in use.

34 Claims, 7 Drawing Sheets

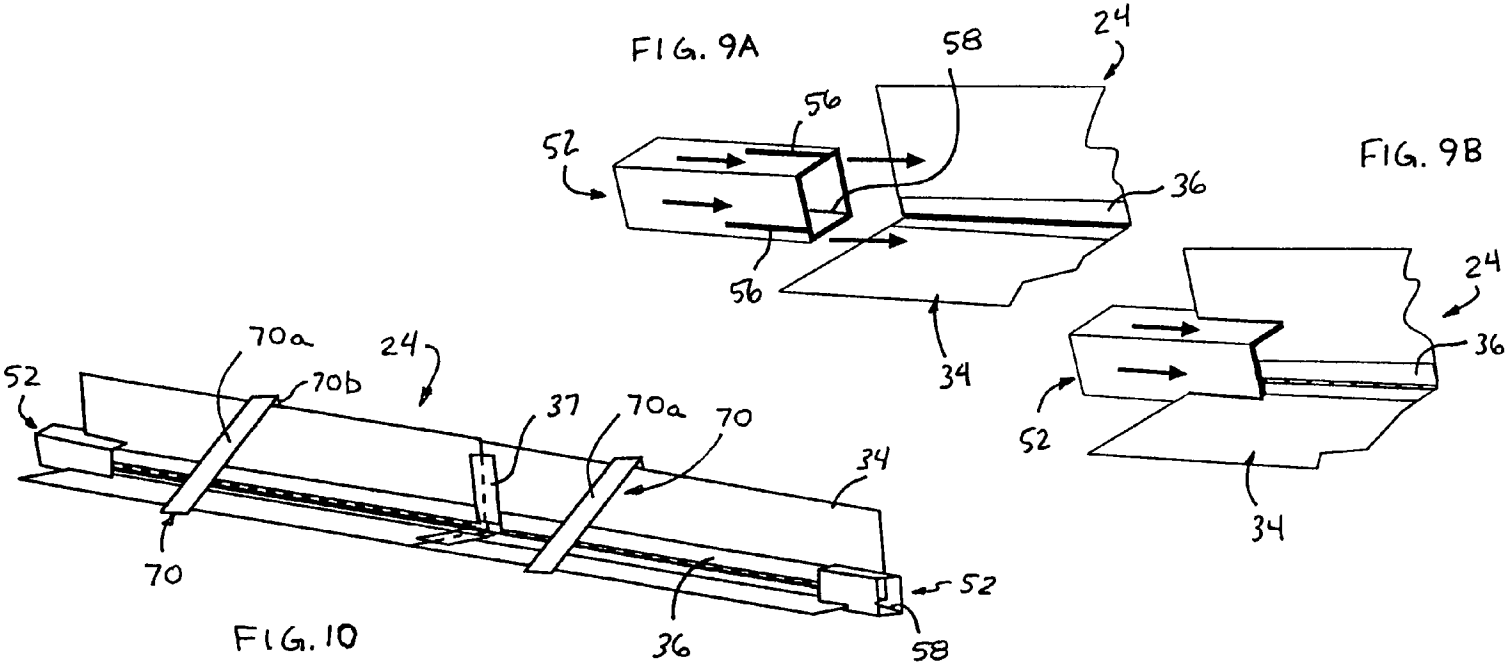
FIG. 9A
FIG. 9B
FIG. 10
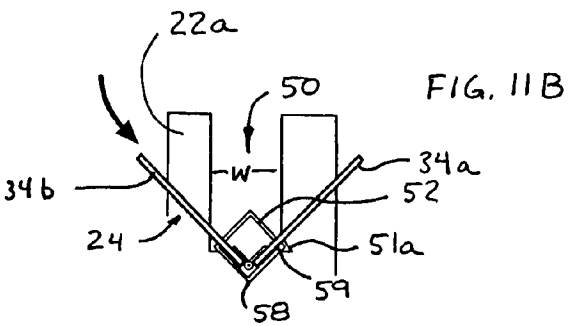
FIG. 11B
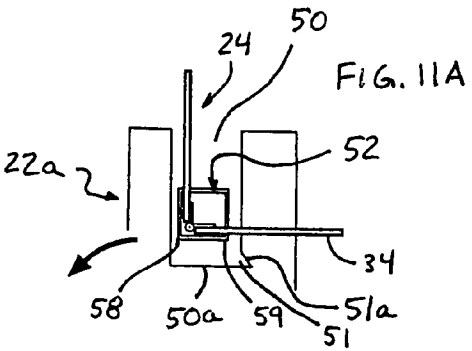
FIG. 11A

DISPLAY BOOTH FRAMEWORK

CROSS REFERENCE TO RELATED APPLICATION

The present application claims benefit of U.S. provisional application, Ser. No. 60/445,935, filed Feb. 7, 2003, which is hereby incorporated herein by reference in its entirety.

FIELD OF THE INVENTION

The present invention relates generally to display booths, such as those found at trade shows and the like, and, more particularly, to a framework for constructing such trade booths.

BACKGROUND OF THE INVENTION

In the past, truss systems have often been used to construct display booths, The truss systems use vertical posts to which are mounted one or more horizontal beams. Typically, the posts are placed at the corners of the floor space that has been allotted to the particular vendor who is using the booth. The posts extend vertically upward a preset distance, such as about eight feet or thereabouts. At the top of the posts, horizontal beams are supported that extend between each of the posts. Banners, signs, or other display material may be hung from the horizontal beams.

The prior truss systems have suffered from several disadvantages. First, the trusses are usually constructed in such a fashion that they are relatively heavy items. This makes transporting them difficult, as well as manipulating them during construction and deconstruction of the booth. Second, the trusses and other components used to construct the booth are often long, such as eight feet or more. This also makes the transportation, as well as the storage, of these components difficult. Further, prior trade show booth frames have often required the use of separate fasteners to secure together all of the components of the frame. This increases the time and labor necessary to construct and deconstruct the booth framework.

Therefore, there is a need in the art for a trade show display booth framework that overcomes these and other difficulties encountered by the conventional systems and booths.

SUMMARY OF THE INVENTION

The present invention provides a display booth framework that is compact, easy to assemble and disassemble, and highly transportable, and that occupies a minimal amount of space when stored. The framework further provides an aesthetically pleasing look while being both durable and lightweight.

According to an aspect of the present invention, a framework for a display booth includes a base, at least one post, at least one horizontal beam, and at least one connector. The post is adapted to be releasably attached to the base and to extend vertically upward from the base when attached thereto. The post includes at least two panels that are pivotally secured together. The horizontal beam is adapted to be releasably attached to the post, and includes at least two panels pivotally secured together. The connector is adapted to be releasably attached to both the post and the beam, and to support the horizontal beam on the post when the connector is connected to both the post and the beam.

According to other aspects of the present invention, the panels of the posts and beams may be made up of aluminum sheets that surround a plastic layer sandwiched therebetween. The base may be adapted to support the post panels in a specific orientation when attached thereto. For example, the post panels may extend from the base at a desired angle, such as approximately ninety degrees. The connector may include a plurality of openings for receiving portions of the post and portions of the beam.

Optionally, a sign holder may be included that can be releasably attached to the beam and that may support a sign, banner, or the like. Each of the panels of the posts and the beams may be sub-divided into smaller panels that are pivotally secured together so that the posts and beams can be folded to smaller sizes when disassembled. The smaller size allows the components of the framework to be placed within a relatively small carrying case for easy transportation and storage. Multiple posts may be interconnected by multiple beams and connectors to form a larger display booth framework if desired.

Therefore, the present invention provides a framework for a display booth that is readily assembled at a display area. The posts and beams of the display booth framework may be connected together to secure the framework in a desired shape or orientation. A sign and/or lights may be provided at the posts and/or beams to enhance the display booth when in use. The display booth framework may be readily disassembled and folded and stored to ease transportation and storage of the display booth framework when it is not in use.

These and other objects, advantages, purpose and features of the present invention will become apparent upon review of the following specification in conjunction with the drawings.

BRIEF DESCRIPTION OF THE DRAWINGS

FIGS. 9A and 9B are perspective views of an end of the beam, showing how the connector is mounted to the end of the beam;

FIG. 10 is an upper perspective view of the beam with a connector mounted at each end of the beam;

FIGS. 11A and 11B are side elevations of the upper end of the post, showing how the connector and beam are mounted to the upper end of the post;

DESCRIPTION OF THE PREFERRED EMBODIMENTS

Figure 1:
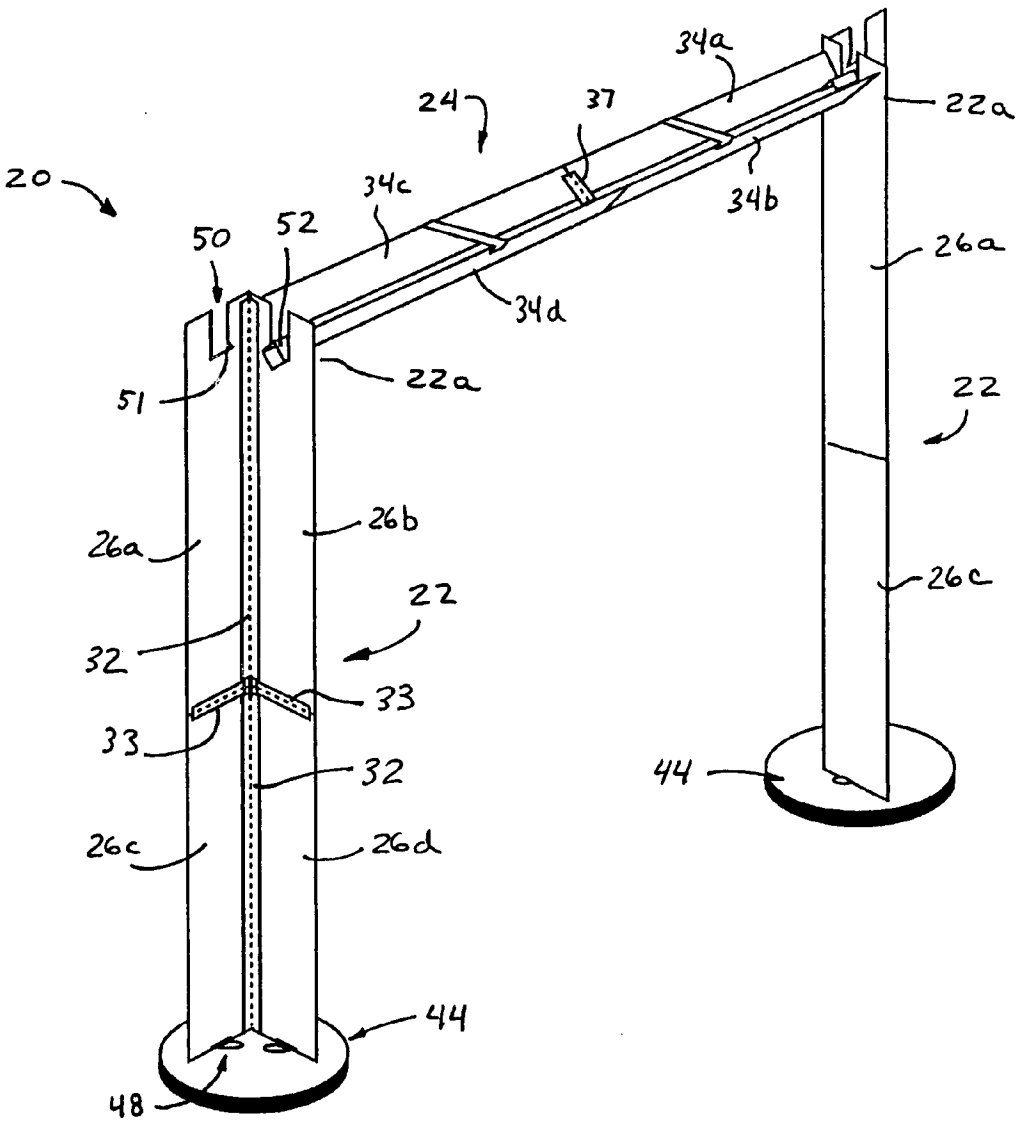
FIG. 1 is a perspective view of a display booth framework in accordance with the present invention.
Figure 12:
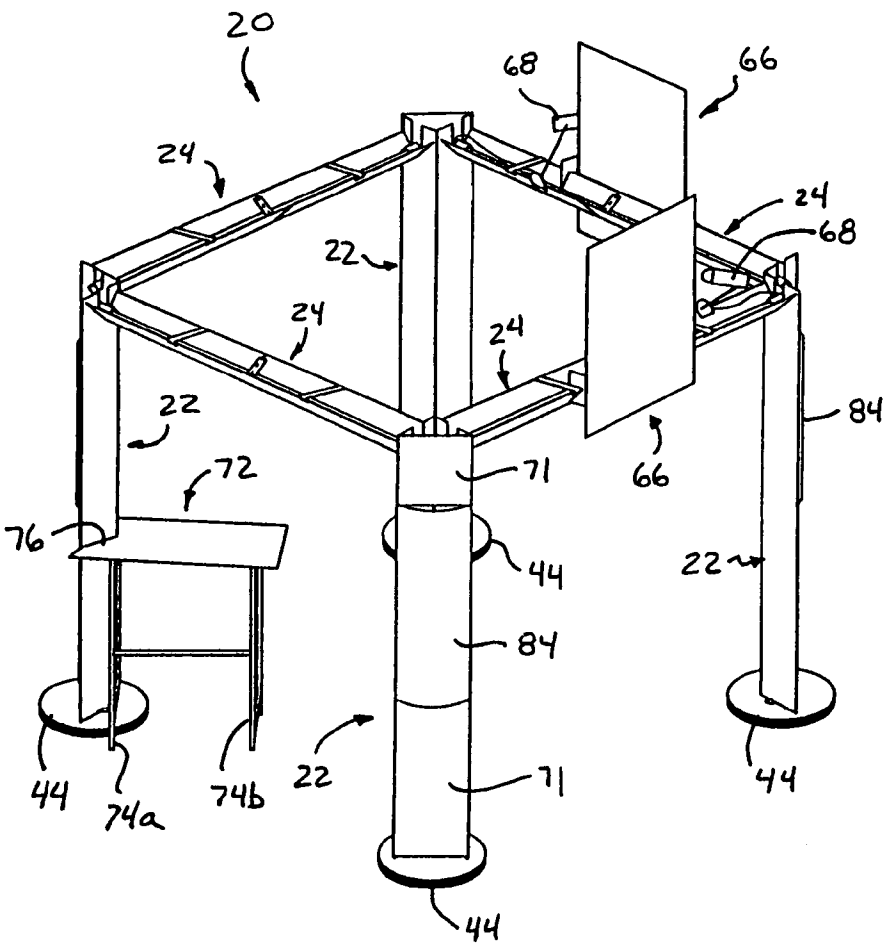
FIG. 12 is a perspective view of another display booth framework in accordance with the present invention.

Referring now to the drawings, the present invention will be described below, wherein the reference numerals in the following written description correspond to like-numbered elements in the accompanying drawings. One example of a display booth framework 20 that may be constructed in accordance with the present invention is depicted in FIG. 1. Framework 20 includes a pair of generally vertically oriented posts 22 and a horizontally oriented beam 24 that extends across the tops or upper ends 22*a* of the posts 22 and is supported thereby. In general, the framework may be used as part of a display booth in a trade show type environment, although the invention finds application to other fields. When used at a trade show, it may be desirable to add more posts 22 and beams 24 than that depicted in FIG. 1. For example, and as shown in FIG. 12, it may be desirable to include a post 22 at each of the corners of a square or rectangle so that the posts define, or are adjacent to, the corner areas of the floor space that is assigned a particular vendor at a trade show or other type of show. Each of the posts 22 may be attached to two horizontal beams 24 that are oriented with respect to each other at right angles. The beams 24 may thus form a square or rectangle, which is supported at its corners by the posts 22. Each beam 24 may be used to support a banner, poster, or other printed material for displaying advertising or other information, as discussed below. Electrical cables, computer wires, and other types of cords may be concealed in the posts and beams and may provide interconnections to electrical and electronic components and accessories that may be used in the display booth, as also discussed below.

Figure 2:
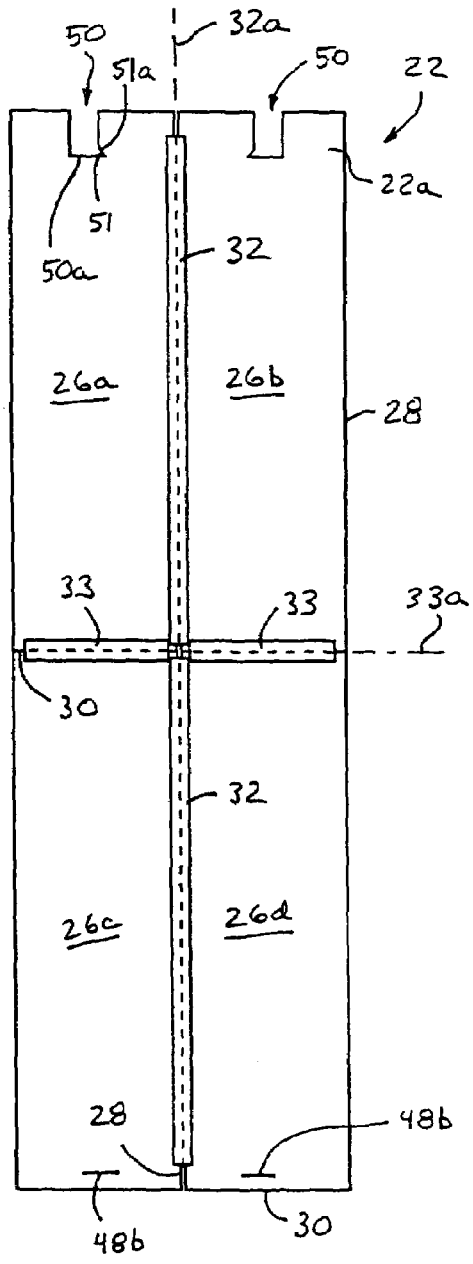
FIG. 2 is a side elevation of a post of the display booth framework of FIG. 1.

In the illustrated embodiment, each post 22 is made up of four separate panels 26*a–d* that are interconnected in a pivotal manner (FIG. 2). Specifically, each panel 26 includes two long sides or edges 28 and two short sides or edges 30. One of the long sides 28 of a first panel 26*a* is connected to one of the long sides 28 of a second panel 26*b* by an elongated hinge 32. One of the short sides 30 of the first panel 26*a* is also connected to one of the short sides 30 of a third panel 26*c* by a separate hinge 33. The third panel 26*c* is further connected along one of its long sides 28 by an elongated hinge 32 to the long side 28 of a fourth panel 26*d*. The short side 30 of the fourth panel 26*d* adjacent second panel 26*b* is also hingedly connected to the short side 30 of second panel 26*b* by another hinge 33. Accordingly, opposite pairs of panels 26*a*, 26*c* and 26*b*, 26*d* are pivotally connected together by hinges 32 and are thus pivotable along a longitudinal axis 32*a* of post 22, while opposite pairs of panels 26*a*, 26*b* and 26*c*, 26*d* are pivotally connected together by hinges 33 and are thus pivotable along a lateral axis 33*a* that is generally normal to the longitudinal axis 32*a*.

Similarly, the beam or beams 24 may comprise a plurality of panels 32*a–d* that are hingedly joined together via an elongated hinge 36 along their long sides or edges 38 and a separate hinge 37 along their short sides or edges 40. The beams 24 thus have opposite pairs of panels 34*a*, 34*c* and 34*b*, 34*d* that are pivotally connected together by hinges 36 and are thus pivotable along a longitudinal axis 36*a*, while opposite pairs of panels 34*a*, 34*b* are 34*c*, 34*d* are pivotable along a lateral axis 37*a* that is generally normal to the longitudinal axis 36*a*.

Figure 3:
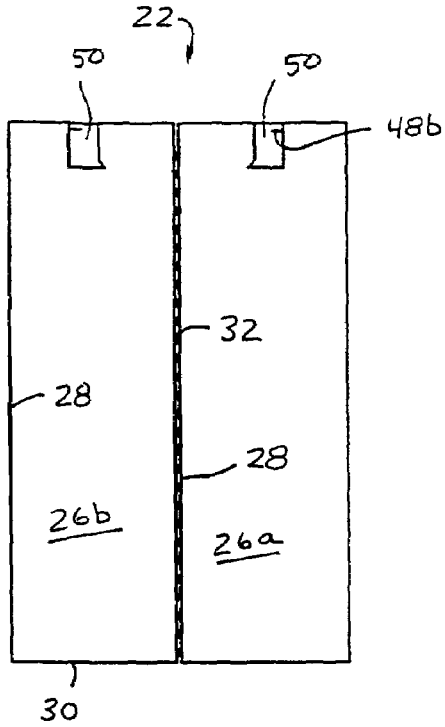
FIG. 3 is a side elevation of the post of FIG. 2, with the post in a folded orientation.
Figure 7:
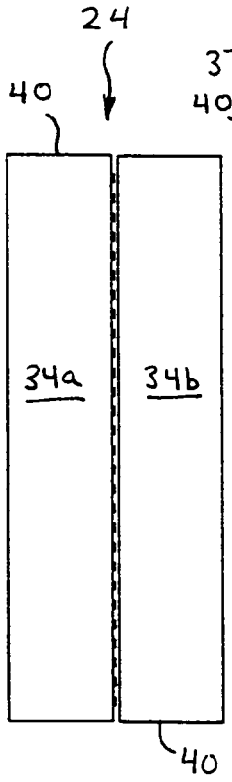
FIG. 7 is a plan view of the beam of FIG. 6, with the beam in a folded orientation.
Figure 6:
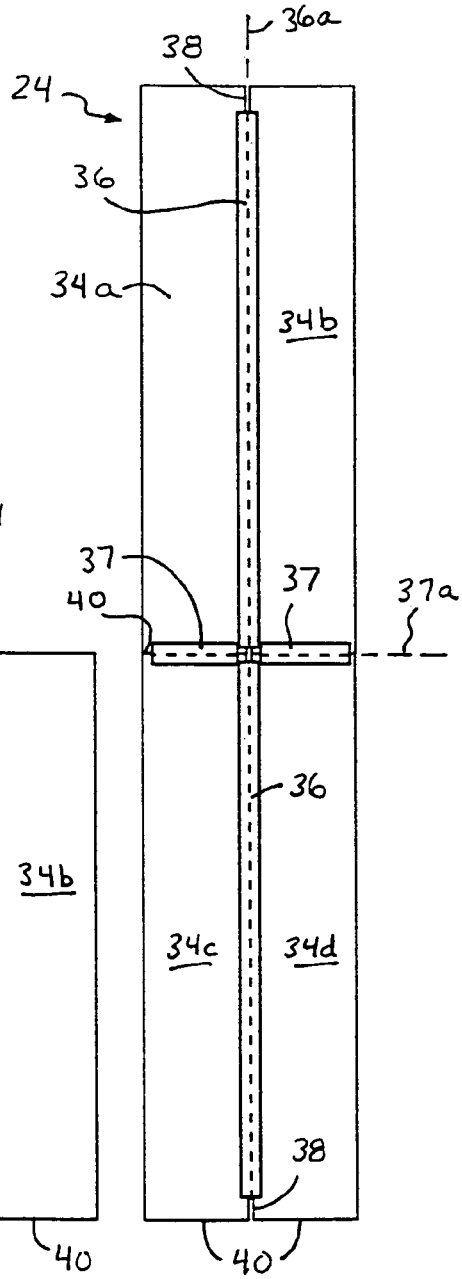
FIG. 6 is a plan view of a beam of the display booth framework of FIG. 1.

The entire post 22 or beam 24 can thus be folded in half along the hinges 33, 37 at and along the junction of the short sides 30, 40 of each of the four panels 26, 34. This allows the post or beam to be stored in a relatively compact manner (as shown in FIGS. 3 and 7, respectively). Each post or beam may extend for approximately eight feet in an unfolded condition (as shown in FIGS. 2 and 6, respectively), although other lengths can, of course be used. By constructing posts 22 and beams 24 in a manner that allows them to fold, they can be stored in spaces no bigger than half their length (e.g. approximately four feet).

Post 22 is also foldable along the hinge connections between the long sides 28 of first and second panels 26*a* and 26*b*, as well as the long sides of third and fourth panels 26*c* and 26*d*. Likewise, beam 24 is also foldable along the hinge connections between the long sides 38 of the panels. This folding does not need to allow the panels to fold over onto the other to completely touch each other, although such a degree of folding can be constructed if desired. In the illustrated embodiment, posts 22 and beams 24 are foldable along their longitudinal axes 32*a*, 36*a* within a range from at least zero degrees to ninety degrees. In other words, for example, panels 26*a* and 26*c* can be pivoted from being co-planar with panels 26*b* and 26*d* (where the post may be folded about either axis) to a position in which they are oriented at approximately right angles with respect to panels 26*b* and 26*d*. When in use, panels 26*a* and 26*c* are maintained at right angles, or another selected orientation, with respect to panels 26*b* and 26*d*, as discussed below. When being stored, panels 26*a* and 26*b* may be folded to be generally co-planar and then folded over about axis 33*a* with respect to panels 26*c* and 26*d* so that the entire post or beam remains generally flat.

The hinges 32, 33 and 36, 37 used to secure together the panels 26, 34 can be any suitable type of hinge. Hinges 32, 33 and 36, 37 may be secured to panels 26, 34 by way of commercially available ultra-high bond (UHB) double-sided tape, although any other suitable means for securing the hinges to the beams and/or posts be used within the scope of the invention. Panels 26, 34 are preferably, although not necessarily, made from lightweight aluminum composite panels, such as Econolite. Econolite is a commercially available panel having a corrugated polyallomer (CPA) core with a thin painted aluminum face and an unpainted, light gauge aluminum backer. The panels thus comprise a plastic core sandwiched between opposite sheets of aluminum. This material provides suitable strength while not being unduly heavy. However, other materials may be implemented, without affecting the scope of the present invention.

Figure 4:
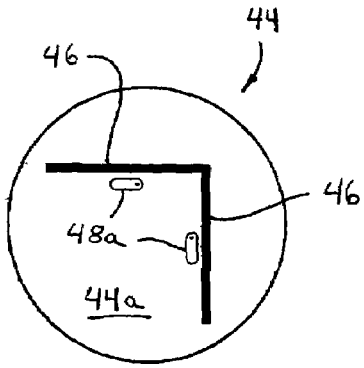
FIG. 4 is a plan view of a base of the display booth framework of FIG. 1.
Figure 5:
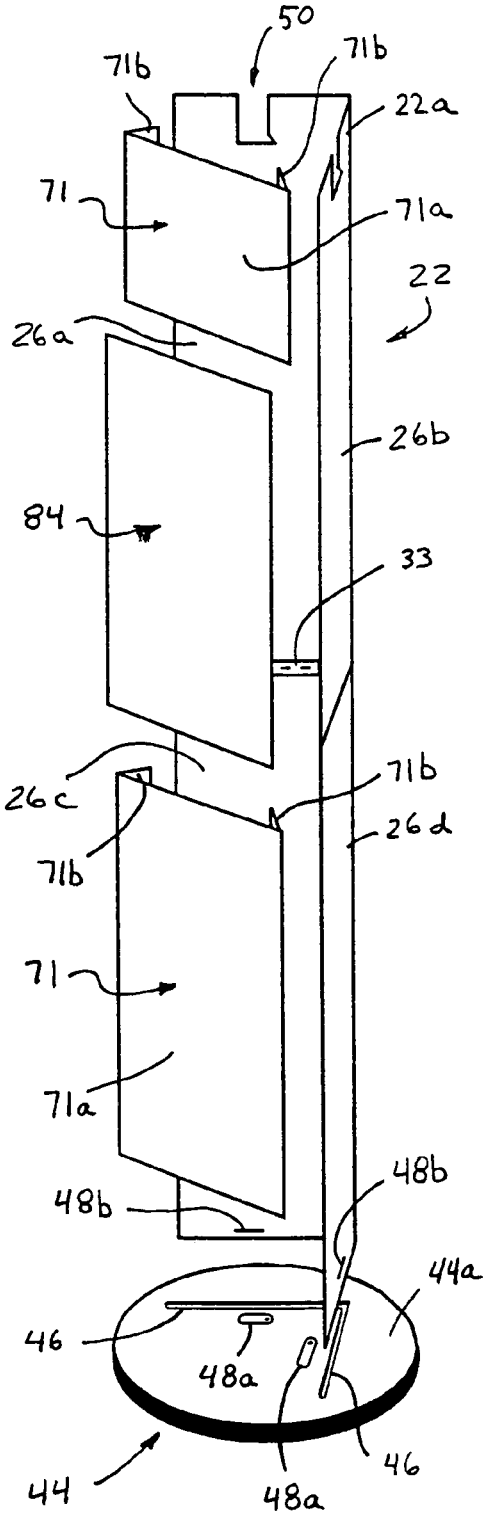
FIG. 5 is an exploded perspective view of a post and base of the display booth framework.

Each post 22 is held generally vertically by a base 44 (FIGS. 1, 4 and 5). Each base 44 may be constructed of a generally flat material, such as wood or metal or plastic or the like, without affecting the scope of the present invention. As best shown in FIGS. 4 and 5, base 44 includes a pair of channels 46 (or a single angled channel) defined on its top surface 44*a*. Channels 46 are dimensioned to have a width that is substantially the same as the thickness of the panels 26 that make up post 22. Further, each channel 46 is oriented with respect to the other channel at a pre-selected angle, which, in the illustrated embodiment, is approximately ninety degrees. This pre-selected angle determines what angle panels 26*a* and 26*c* will be oriented at with respect to panels 26*b* and 26*d* of post 22. Post 22 is set up by inserting the bottom ends of the two lower panels 26*c*, 26*d* into the two channels 46.

The lower panels may be locked in channels 46 by way of a pair of locks or locking devices 48. In the illustrated embodiment, locks 48 include a pivotable table or latch or locking member 48*a* pivotally mounted to base 44 and at or adjacent to one or both of the channels 46. The tabs 48*a* may be pivoted to engage and insert at least partially through a corresponding slot 48*b* (FIGS. 2 and 5) in the respective panels 26*c*, 26*d* when the post is inserted into channels 46. When tabs 48*a* are pivoted into slots 48*b* is post 22, the post is held to base 44 and cannot be readily removed from the base. Optionally, the locks or locking devices may comprise any other form of locking device, such as, for example, conventional locks that selectively move a latch or pin into and out of holes defined near the bottom of the post, or other types of locking of retaining devices or mechanisms, without affecting the scope of the present invention. Base 44 preferably may be dimensioned to be sufficiently long and sufficiently wide (or of a sufficient diameter) to maintain post 22 in a generally vertical position on the floor without tipping.

Each post 22 includes one or more cutouts or slots 50 that are used to support a connector 52 at the ends of one or more horizontal beams 24. In the illustrated embodiments, cutouts 50 are positioned at the top or upper end 22*a* or panels 26*a*, 26*b* of each post 22. It will be understood, of course, that cutouts 50 could also be positioned at any other height or heights along posts 22, if desired. Cutouts 50 may generally have a simple square or rectangular shape with a lower notch 51 defined therein. The purpose of notch 51 will be described in more detail below.

In the illustrated embodiment, cutouts 50 support horizontal beams 24 by way of connector 52 (FIGS. 1, 8, 9 and 11). Connector 52 may comprise a generally rectangular member having a post receiving aperture 54 and two beam receiving slots 56. As shown in FIGS. 8A–E, connector may comprise a hollow or tubular rectangular member, but may be other shapes, without affecting the scope of the present invention. As shown in FIGS. 9A and 9B, each beam receiving slot 56 receives a panel 34 of the horizontal beam 24. The panels 34 are inserted into beam receiving slots 56 so that the hinge 36 between the long sides of the panels 34 will be positioned generally adjacent to or along a corner or edge 58 of connector 52. When panels 34 are so inserted, connector 52 maintains the two connected panels at about a ninety degree angle with respect to each other and extends from the end of the panel for engaging the respective post 22, as discussed below. When connector 52 is attached to the beam 24, the panels 34 that make up the horizontal beam 24 are thus held by connector 52 (which holds the beam to the post as discussed below) in a generally V-shaped orientation with the bottom of the V-shaped beam facing downward or toward the floor (FIGS. 1, 10 and 11B). This V-shaped arrangement allows the horizontal beam to act as a sort of trough in which cables or other wires can be run, such as discussed below, while providing enhanced structural rigidity of the beam to limit downward flexing of the beam between the posts.

Figure 8B:
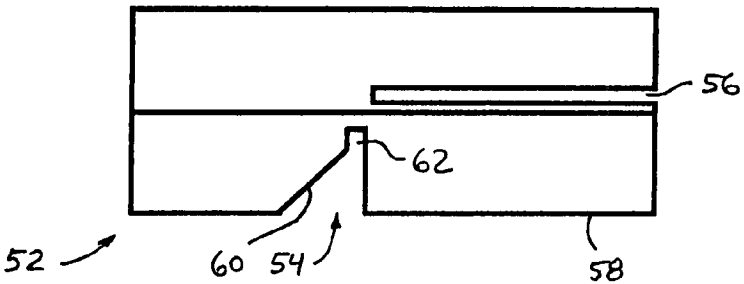
FIGS. 8A–E are views of a connector useful for connecting the beam to the post.
Figure 8E:
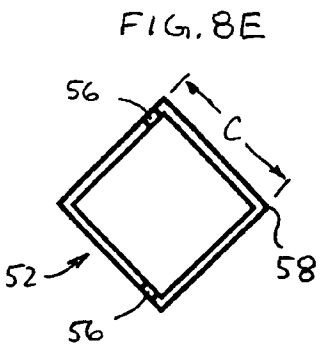
Figure 8D:
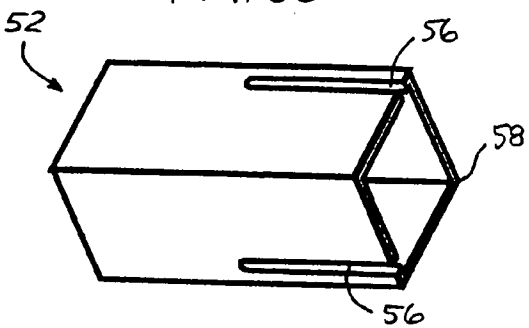
Figure 8A:
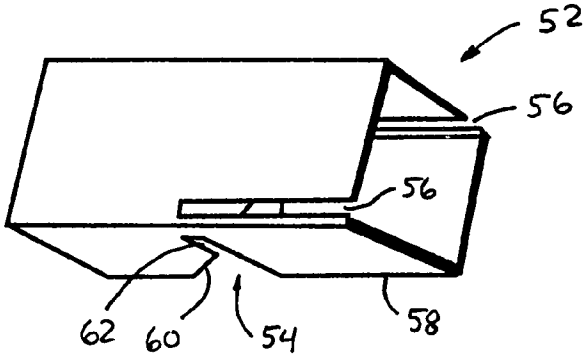
Figure 8C:
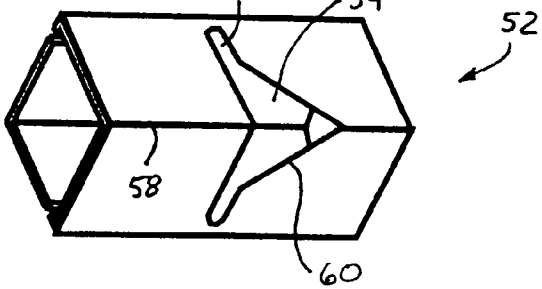

Each beam 24 of framework 20 is held up by the connector 52 attached at each end of the beam and supported by a respective post 22. Post receiving aperture 54 is defined in connector 52 generally on or in the opposite side of connector 52 as beam slots 56 and functions to support and retain connector 52 (and the beam 24 attached to the connector) on a post 22. As best shown in FIGS. 8B and 8C, post receiving aperture 54 comprises a generally triangular-shaped aperture having a tapered section 60 and two corner slots 62 formed along and through adjacent sidewalls of the connector 52. Corner slots 62 may have a width generally equal to the width of one of the upper panels 26*a*, 26*b* of the post 22, such that the respective panel may be slidably received within the slots when the connector is connected to the post 22.

Referring now to FIGS. 11A and 11B, the size or width or diameter of connector 52 may be selected relative to the width of cutout 50, such that connector 52 may be lowered into and along cutout 50 in one orientation and then rotated approximately 45 degrees to receive the panel 26 within slots 62. As shown in FIG. 11A, connector 52 (with beam 24 attached thereto) may be lowered into and along cutout 50 until the connector is generally at the bottom of the cutout. The connector 52 and beam 24 may then be rotated (such as in the counter-clockwise direction in FIG. 11B) so that the bottom edge 50*a* of cutout 50 is received within post receiving aperture 54 and within corner slots 62 of connector 52 to retain connector 52 on post 22. The tapered section 60 of the post receiving aperture 54 functions to guide the cutout edge 50*a* into the aperture and into the corner slots 62 as the connector is rotated. Each corner slots 62 thus receives a portion of the panel 26 in which the post cutout 50 is defined. As connector 52 is rotated, one of the corners 59 (FIGS. 11A and 11B) of the connector may be at least partially received into the notch 51 of the cutout 50, as can be seen in FIG. 11B. When connector 52 is positioned in such an orientation relative to cutout 50 of post 22, connector 52 is substantially retained in the cutout 50 and cannot be readily raised upward to dislodge the connector and beam from the post. As also shown in FIG. 11B, the corner or edge 58 of connector 52 may point generally downward toward the floor and may be the lowest point on connector 52 when connector 52 is attached to the vertical post 22. Connector 52 is thus held on post 22 with panel 26 inserted into corner slots 62 by way of gravity acting on the connector and beam assembly. Connector 52 can be readily detached from post 22 simply by rotating the connector and beam in the opposite direction (such as the clockwise direction in FIG. 11B) and lifting connector or connectors 52 and beam 24 generally vertically.

Figure 16:
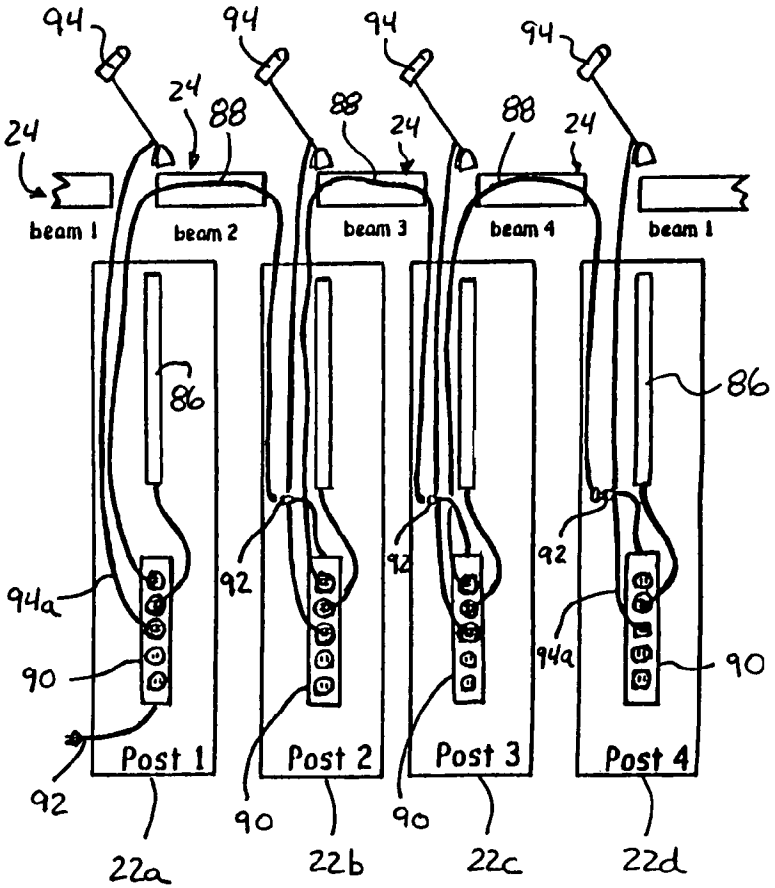
FIG. 16 is a schematic of an electrical system suitable for use in the display booth framework of the present invention.
Figure 15:
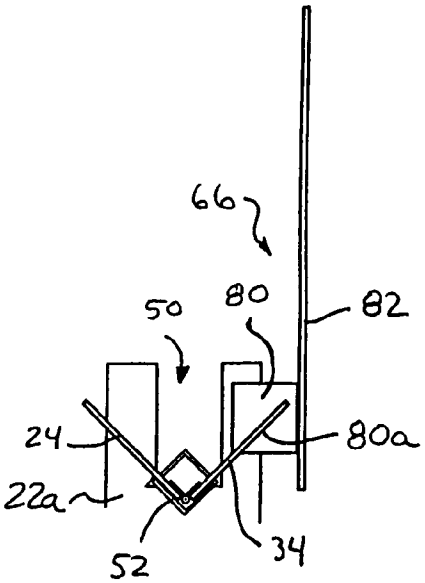
FIG. 15 is a side elevation of a bracket and a sign holder that can be attached to one of the beams.

Notch 51 thus helps maintain beam 24 in a locked positioned when beam 24 and connector 52 are attached to post 22. The dimensions of the connector and the notches are selected to provide ease of assembly and the desired retention of the connector within the notch or slot. For example, in the illustrated embodiment, cutout 50 has a width W (FIG. 11B) that is preferably less than the distance from one corner of connector 52 to its opposite corner. Stated alternatively, and with reference to FIGS. 8E and 11B, if each side of connector 52 has a width of C, then the width W of cutout 50 is preferably less than the square root of two (i.e., approximately 1.4142) times the connector width C. By having the cutout width W less than this distance, connector 52 must initially be inserted into cutout 50 with one of its sides generally parallel to the floor. After connector 52 is fully inserted into cutout 50, connector 52 (and beam 24) can then be rotated 45 degrees, such as in a counterclockwise direction in FIG. 11B, so that all four of its sides have an angle with approximately a 45 degree magnitude with respect to horizontal. Notch 52 provides clearance for this rotation. An upper edge 52*a* of notch 51 limits or substantially precludes further rotation of connector 42 and beam 24 in a counterclockwise direction from that illustrated in FIG. 11B. When any objects, such as a sign support 66 or lights 68 (such as shown in FIGS. 12, 15 and 16 and discussed below) or other objects or items or the like, are supported on beam 24, they are desirably positioned on the panel of beam 24 that faces away from notch 51 (such as panel 34*b* or 34*d* in FIGS. 1 and 11B). Thus, the weight of any such objects tends to urge beam 24 to rotate in a counterclockwise direction (as viewed in FIG. 16). However, edge 51*a* prevents any further rotation of beam 24 in a counterclockwise direction. Edge 51*a* of notch 51 thus prevents beam 24 from tipping when weighted with signs or other objects. While different dimensions can, of course, be used in accordance with the present invention, width W of cutout 50 may be approximately 2.5 inches; connector width C may be approximately two inches; and the height of notch 51 may be approximately 0.75 inches, while the width of cutout 50 (including notch 51) along its bottom edge may be approximately three inches. When beam 24 is to be detached from post 22, connector 52 and beam 24 are simply rotated in a clockwise direction approximately 45 degrees and then raised or lifted out of cutout 50.

Optionally, and as shown in FIG. 10, beam 24 may include a closure bracket 70 to retain the beam panels at the desired angle relative to one another. Closure bracket 70 includes a generally flat, planar body 70*a* and two end flanges 70*b*. Each end flange 70*b* may be oriented generally at about a forty-five degree angle with respect to the plane defined by body 70*a*. Closure bracket 70 may be placed on top of one of the horizontal beams 24, and each end flange 70*b* may fit around one of the two adjacent panels 34 that define part of beam 24. The panels may thus be held in a generally V-shaped orientation, and bracket 70 may essentially connect the upper portions or edges of the V-shaped beam, thereby changing the V-shaped cross-section into a cross-section of a right triangle. Preferably, the longitudinal hinges 36 of beam 24 function to allow the beam panels 34 to pivot toward one another so as to be approximately ninety degrees relative to one another, but limit further pivoting of the panels toward one another. Because the panels 34 that closure brackets 70 are connected to are oriented at approximately ninety degrees with respect to each other (and each one is angled at about forty-five degrees from vertical), the forty-five degree end flanges 70*b* may fit around the ends of each of the panels. The closure brackets may be sized to apply an inward pressure on the panels 34 to squeeze the outer edges of the panels toward one another to retain the beam in the desired orientation or shape and to enhance the structural rigidity of the beam. End flanges 70*b* may be dimensioned slightly smaller and closer together that the distance between the unhinged edges of panels 34 so that the end flanges of closure bracket 70 may snap fit onto these unhinged edges. Alternately, it has been found that the mere weight of beam 24 tends to cause the V-shape of panels 34 of beam 24 to bow outwardly from each other more than the ninety degrees defined by connector 42. This outward bowing provides sufficient pressure against each of end flanges 70*b* to frictionally retain closure bracket or brackets 70 on beam 24. Although the closure brackets 70 are depicted in FIGS. 1, 10 and 12 as having a relatively narrow body 70*a* (such as, for example, approximately two inches wide), it will be understood that the closure bracket or brackets could have bodies that are much wider, and that may extend substantially along the beam, without affecting the scope of the present invention.

Optionally, an elongated closure bracket or post cap 71 (FIGS. 5 and 12) may be provided along or partially along one or more of the posts 22 of the framework. Optionally, such wide bodied brackets or panels could be used to connect to the panels 26 defining the posts 22. This would change the cross-sectional shape of the posts 22 from that of a V-shape to that of a right triangle. By increasing the width of the closure brackets, the brackets may extend for a substantial portion of the length of one of the posts 22, or even the entire length. For example, and as shown in FIGS. 5 and 12, one or more elongated closure bracket 71 may be provided at a lower portion of the posts 22 to conceal the inside of posts 22 to enhance the appearance of the framework and optionally to define an internal cavity into which electrical wiring and other components could be positioned or mounted, as discussed below. This would allow posts 22 to be constructed as three-sided structures with no openings into the internal cavity defined by the three sides of the post and bracket assembly. Optionally, a display panel or illuminated panel 84 may be provided along the post to display information or the like to people at the display booth, as discussed below.

Similar to closure bracket 70, discussed above, the closure brackets 71 include a body portion 71*a* and opposite end flanges 71*b* for engaging the edges of the panels 26 of post 22. Preferably, the elongated hinges 32 of post 22 function to allow the post panels 26 to pivot toward one another so as to be approximately ninety degrees relative to one another, but limit further pivoting of the panels toward one another. Because the panels 26 that closure brackets 71 are connected to are oriented at approximately ninety degrees with respect to each other, the forty-five degree end flanges 71*b* fit around the ends of each of the panels. The closure brackets or panels 71 may be sized to apply an inward pressure on the panels 26 to squeeze the outer edges of the panels toward one another to retain the post in the desired orientation or shape and to enhance the structural rigidity of the post.

Referring now to FIG. 12, the framework 20 may include four posts 22 and four beams 24 connected at and between the upper ends of adjacent or respective posts. Framework 20 thus may comprise a free-standing booth or display area. Optionally, framework 20 may provide or support other attachments or devices, such as a table or bench 72, one or more signs or sign supports 66 and/or one or more lights 68 and/or the like, as discussed below.

Figure 14:
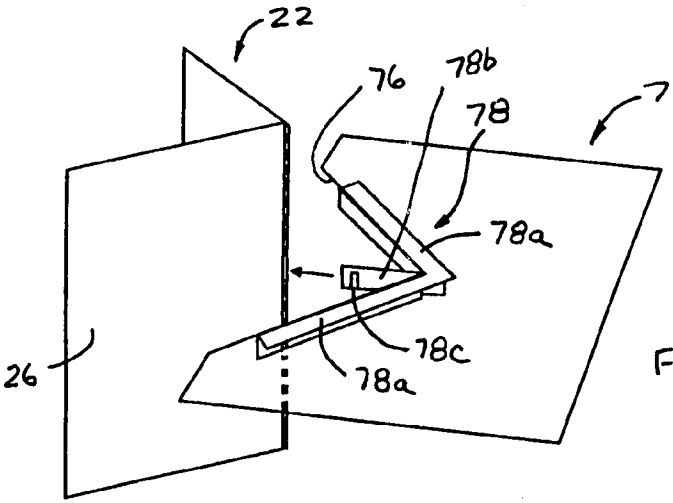
FIG. 14 is a perspective view of a shelf that is mountable to a post of the display booth framework.
Figure 13:
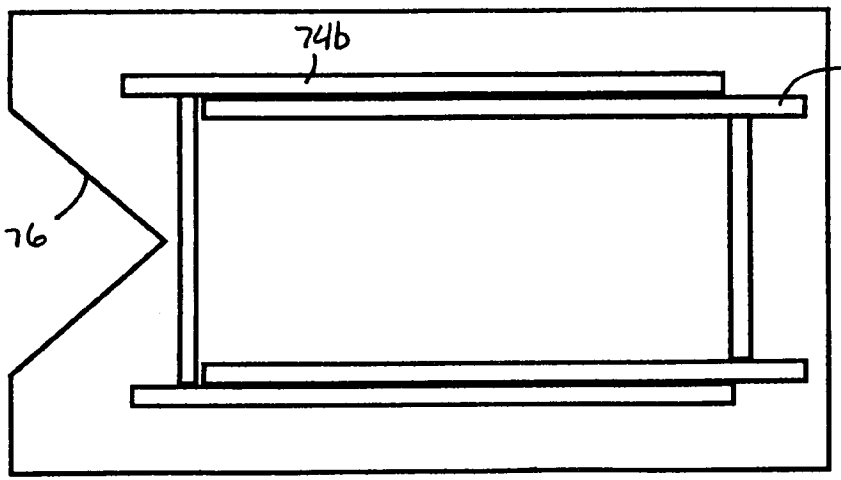
FIG. 13 is an underside plan view of a table that is mountable to a post of the display booth framework.

For example, a table 72 may optionally be incorporated into framework 20, if desired, and, as shown in FIGS. 12 and 13, may be attached to a post 22 of framework 20. Table 72 is preferably a folding table that may be folded to a generally flat condition, when not in use. Optionally, table 72 may include one or more ledges, such as foldable legs 72*a*, 72*b* in FIGS. 12 and 13. Optionally, the legs may be removed or not provided, such that a shelf or table 72' (FIG. 14) may be cantileverly supported from post 22 such that post 22 provides the sole support of table 72'. Optionally, a table or bench may extend all the way between two posts 22 of framework 20 so that each end of the table is supported by a post 22. In such an application, no legs would be necessary for the table.

The table 72, 72' includes a V-shaped notch 76 defined in one end of its work surface. Notch 76 is shaped to match the V-shape formed by the panels 26 of post 22 when held vertically in base 44. The edges of notch 76 may also be supported on post 22 by way of a table bracket 78 (shown in FIG. 14 with table 72', but is equally suitable for other types of tables, such as table 72, or other attachments or the like that may desirably be attached to and supported on the post or posts of the framework). Table brackets 78 includes two generally horizontal flanges 78*a* that are joined together at approximately a right angle. Table bracket 78 includes a vertical flange 78*b* having a square notch 78*c* defined in its lower edge. Vertical flange 78*b* extends outwardly from the junction of flanges 78*a* at an angle of approximately 45 degrees relative to the flanges. Vertical flange 78*b* fits into the space defined between the two adjacent long sides or edges 28 of panels 26 that are hinged together by longitudinal hinge 32. Notch 78*c* may rest on top of the upper end of one of the elongated hinges 32 of post 22, such that bracket 78 and the table are thereby supported on post 22. Flanges 78*a* provide ledges on which the table work surface may be positioned and at least partially supported. Optionally, flanges 78*a* could be modified to provide an attachment mechanism for securing the work surface to bracket 78, if desired.

Optionally, a sign support 66 may be provided along one or more of the beams 24, as shown in FIGS. 12 and 15. Sign support 66 may comprise one or more mounting brackets 80 for supporting or attaching a panel or sign 82 at one or more of the panels 34 of beam 24. A bracket 80 may be provided at opposite ends of the sign or panel 82 or may be positioned elsewhere along the panel to provide sufficient support of the panel at the beam. As shown in FIG. 15, brackets 80 provide a panel receiving channel or slot 80*a* for receiving an outer portion of one of the panels 34 of beam 24. The channel or slot 80*a* may be defined in bracket 80 at approximately a 45 degree angle, such that the slot may match the 45 degree angle orientation of one of the panels 34 of beam 24. Sign support 66 may thus be mounted to a panel 34 of beam 24 by sliding brackets 80 onto the panel 34 so that the panel 34 is received within slot 80*a* to retain sign support 66 onto beam 24. The sign support bracket 80 may include a planar front face that may have Velcro or other type of fastener secured thereto. The Velcro or other faster may be used to attach the sign, panel, banner, poster, or the like 82 to the bracket. As shown in FIG. 15, the front face of bracket 80 may extend generally vertically upward above the beam. This allows a sign or panel to be positioned and held above the horizontal beam 24 to which sign support 66 is attached. If it is desired to hold signage below the horizontal beam, an upper portion of the sign or panel may be attached to the front face of the bracket so that the sign or panel may hang downward from the sign support. The sign or panel or the like 82 may provide advertisements or other messages or the like to display the desired message or information to people viewing the sign or panel at the display booth.

Although shown as having a slotted bracket for slidably receiving an edge of the beam panel, a sign support may be secured to a beam 24 in a variety of different manners from that described above, without affecting the scope of the present invention. For example, one of the closure brackets at the beam may include an aperture, while the sign support may include a shoulder that may fit into the aperture, in order to releasably support a sign support at the closure bracket.

Optionally, it may also be desirable to include one or more back-lit display panels 84 that extend between the panels 26 of posts 22, such as in areas where no closure bracket 71 is positioned. As shown in FIG. 12, brackets or panels 71 may be provided in all other areas of posts 22 except for the areas where a back lit panel 84 is provided, in order to close the post over substantially its entire length. An illumination source 86 (FIG. 16), such as a fluorescent light bulb or other light source, may be mounted in the internal cavity of the post behind the back-lit panel 84 to provide illumination to and through the back-lit panel. The back-lit panel could be constructed generally similar to closure brackets 71, although manufactured of a light-transmitting or translucent material. Optionally, the back-lit panels 84 may comprise a curved body (as shown in FIG. 12), rather than the flat body shown in FIG. 5. The back-lit panel or panels may provide information or test or advertising or the like and may be back lit by the illumination source to enhance the effectiveness of the advertising or the like and to enhance to appearance of the display booth.

Optionally, the posts and/or beams could be pre-wired during manufacture to allow electrical connections to be made thereto without having to thread or install additional wires inside of the posts and beams. For example, the posts 22 of framework 20 may be electrically connected together via electrical wires or conductors, such that electricity may be provided to and may be available at each post 22 of the framework. With reference to FIG. 16, each post 22 may include an outlet strip or electrical junction 90 with a plug connector or wire 92 extending therefrom. For one of the posts 22*a*, the plug 92 may extend from the post and may be plugged into a power supply (not shown) at the display area. The outlet strip 90 at the first post 22*a* may then be connected to the outlet strip 90 at the second post 22*b* via an electrical wire 88 (with the plug 92 of the outlet strip of the second post 22*b* plugging into the wire 88), while the outlet strip at the second post 22*b* may be connected to the outlet strip 90 at the third post 22*c* via an electrical wire 88 and the outlet strip at the third post may be connected to the outlet strip at the fourth post 22*d* via another electrical wire 88. The electrical wires 88 may be routed along the respective posts 22 and along the respective beam 24 so that they may be substantially not readily visible or accessible to people at the display booth. The electrical wiring that may be housed within the posts and beams may be conventional round wires, or may be flat wires or other conductive wiring or the like, without affecting the scope of the present invention.

As shown in FIG. 16, the illumination source 86 for the back lit panel 84 may be plugged into the outlet strip 90 of the respective post. Optionally, one or more other lights or lamps 94 may be mounted to one of the beams 24 to provide illumination of the display booth area. The lights 94 may include a wire or plug 94*a* that may be routed along the respective beam and down along one of the posts 22, where the plug 94*a* may be plugged into an outlet of the outlet strip 90. The lights 94 may clip or otherwise attach or mount to one of the panels 34 of a respective beam 24 and may be angled to direct illumination toward a desired area. The outlet strip or the wires may provide switches or controls that are accessible to a person so that the illumination sources or lights or other electrical components or accessories may be selectively activated and deactivated. The switches or controls may be positioned at an opening in the post panels or in the closure panels so that they may be readily accessible by a user.

While the beams 24 and posts 22 have been described as both being constructed of four panels 26, 34, they may alternately be made of different numbers of panels. Further, the size of the panels used to construct the posts could be the same as or could be different from the size of the panels used to construct the beams. For example, it may be desirable to construct the posts out of panels having larger dimensions than the panels used in the beams. If the posts and beams are constructed of different dimensions, the length of any closure brackets that are to be attached thereto may have to be altered accordingly in order to match the different dimensions of the posts and beams.

All of the components of the framework of the present invention are designed to be relatively lightweight and to be collapsible so that they can fit into a relatively small carrying case for easy transportation. When the framework is disassembled, the panels of each of the posts and beams may be pivoted so that they are all flat and generally co-planar. They may then be folded along the hinges connecting the short sides of the panels together so that they only extend for about half of their length. After folding, they may remain generally flat and may be stacked on top of each other in a carrying case. The bases may also be generally flat and may be readily stacked on top of panels. Likewise, the table, if used, may be collapsible into a generally flat configuration, and thus may be readily stacked on top of the other generally flat components. The components and brackets are preferably all small enough so that, while not flat, they may easily fit into a carrying case. The carrying case is preferably a wheeled case so that a single person can easily transport the framework. Further, the design of the framework allows a single person to construct the entire framework without additional assistance, if necessary. Also, the entire framework may be assembled without requiring any external fasteners, such as bolts, screws, pins and/or the like.

Therefore, the present invention provides a display booth framework that may be readily assembled and disassembled at a display area. The posts and beams may be folded to a folded orientation when not in use to ease transportation and storage of the framework. When it is desired to assemble the framework, the beams and posts may be unfolded and readily connected together via one or more connectors. Optionally accessories, such as tables, lights, display panels and the like, may be readily attached to the beams or posts of the framework to enhance the appearance and functionality of the display booth. Electrical wiring may be provided along the posts and beams to provide electricity at each post, if desired. The framework provides a structurally rigid framework and may be readily assembled without any separate fasteners, such as bolts and screws and the like.

While the present invention has been described in terms of the preferred embodiments depicted in the drawings and discussed above, it will be understood by one skilled in the art that the present invention is not limited to the particular embodiments described herein, but includes any and all such modifications that are within the spirit and scope of the present invention, which is to be limited only by the scope of the appended claims as interpreted according to the principles of patent law.

What is claimed is:

1. A framework for a display booth comprising:

at least one base;

at least one post releasably attached to said at least one base and extending substantially vertically upward from said at least one base when attached thereto, said post including at least two panels pivotally secured together and pivotable along a longitudinal axis of said post;

at least one beam, said beam including at least two panels pivotally secured together and pivotable along a longitudinal axis of said beam; and a connector releasably attached to said post and said beam, said connector supporting said beam at said post when said connector is attached to said post and said beam is attached to said connector.

2. The framework of claim 1, wherein said base supports said post when attached thereto, a portion of said base engaging said panels of said post such that said panels of said post are held in a specific angular orientation relative to each other by said portion of said base.

3. The framework of claim 2, wherein said specific angular orientation is approximately ninety degrees.

4. The framework of claim 2, wherein said post is held in said specific angular orientation by one or more closure brackets extending between opposite edges of said panels of said post.

5. The framework of claim 1, wherein said connector maintains said panels of said beam in a specific orientation when said beam is attached to said connector.

6. The framework of claim 5, wherein said specific orientation is approximately a right angle.

7. The framework of claim 1, wherein said connector includes a first opening for receiving a portion of said beam and a second opening for receiving a portion of said post.

8. The framework of claim 7, wherein said post is configured to receive said connector in a first orientation, said connector being adjustable relative to said post to a second orientation to retain said connector at said post.

9. The framework of claim 8, wherein said post includes a slot defined in one of said panels, said slot being configured to receive said connector in said first orientation, said connector being insertable into said slot when in said first orientation.

10. The framework of claim 9, wherein said slot includes a notch defined in a lower corner of said slot, said notch receiving a portion of said connector when said connector is adjusted in said second orientation, said notch limiting rotation of said connector and said beam in at least one direction when said connector is in said second orientation.

11. The framework of claim 8, wherein said connector receives said portion of said post when in said second orientation.

12. The framework of claim 1 further including a sign holder releasably securable to said horizontal beam, said sign holder releasably securable to said horizontal beam, said sign holder supporting a sign that is attached to said sign holder.

13. The framework of claim 1, wherein said panels of said at least one post are made of a pair of aluminum sheets surrounding a plastic layer sandwiched between said aluminum sheets.

14. The framework of claim 1, wherein said panels of said at least horizontal beam are made of a pair of aluminum sheets surrounding a plastic layer sandwiched between said aluminum sheets.

15. The framework of claim 1, wherein said post comprises at least four panels, a first and second one of said at least four panels being pivotally secured together along a first pivot axis, a third and fourth one of said at least four panels being pivotally secured together along a second pivot axis generally coaxial with said first pivot axis, said first and third panels also being pivotally secured to each other along a third pivot axis that is generally perpendicular to said first and second pivot axes, said second and fourth panels being secured together along a fourth pivot axis, said fourth pivot axis being generally coaxial with said third pivot axis.

16. The framework of claim 1, wherein said beam comprises at least four panels, a first and second one of said at least four panels of said beam being pivotally secured together along a first pivot axis, a third and fourth one of said at least four panels of said beam being pivotally secured together along a second pivot axis generally coaxial with said first pivot axis, said first and third panels of said beam also being pivotally secured to each other along a third pivot axis that is generally perpendicular to said first and second pivot axes, said second and fourth panels of said beam being secured together along a fourth pivot axis, said fourth pivot axis being generally coaxial with said third pivot axis.

17. The framework of claim 1 including a bracket that at least partially supports a table, said bracket being releasably securable to said post.

18. A framework for a display booth comprising:

at least two bases;

at least two posts, each of said posts being releasably attached to a respective one of said bases and extending substantially vertically upward from said bases when attached thereto, each of said posts including at least two post panels pivotally secured together and being pivotable along a post longitudinal axis of said post to form a generally V-shaped post when said post panels are pivoted toward one another;

at least one beam said beam including at least two beam panels pivotally secured together and being pivotable along a beam longitudinal axis of said beam to form a generally V-shaped beam when said beam panels are pivoted toward one another; and a connector releasably attached to each end of said beam, said connector receiving a portion of said beam panels and said post panels and functioning to retain said beam panels in the generally V-shape, said connectors being releasably attached to respective ones of said posts to support said beam at said posts when said connectors are connected to both said posts and said beam.

19. The framework of claim 18, wherein each of said bases includes a channel formed therein, said channel receiving said post, such that said post panels of said post are held in a specific angular orientation relative to each other by said base.

20. The framework of claim 19, wherein said post is held in said specific angular orientation by one or more closure brackets extending between opposite edges of said panels of said post.

21. The framework of claim 18, wherein at least some of said post panels include a receiving slot at an upper end thereof, said receiving slot at least partially receiving said connector to support said connector and said beam at an upper end of said post.

22. The framework of claim 21, wherein said connector is retained in a specific orientation with respect to said post when said connector is received into said receiving host.

23. The framework of claim 22, wherein said receiving slot is configured to receive said connector in a first orientation said specific orientation of said connector being different than said first orientation, said connector being movable from said first orientation to said specific orientation when said connector is received into said receiving slot.

24. The framework of claim 23, wherein said receiving slot includes a retaining notch defined in a lower corner of said receiving slot, said retaining notch limiting rotation of said connector and said beam in one direction, said connector and said beam being rotatable in the other direction to release said connector from said retaining notch and to move said connector toward said first orientation.

25. The framework of claim 18, wherein said post comprises four post panels, first opposite pairs of adjacent post panels being pivotally secured together along said post longitudinal axis, and second opposite pairs of adjacent post panels being pivotally secured together along a second axis that is generally normal to said post longitudinal axis.

26. The framework of claim 18, wherein said beam comprises four beam panels, first opposite pairs of adjacent beam panels being pivotally secured along said beam longitudinal axis, and second opposite pairs of adjacent beam panels being pivotally secured together along a second axis that is generally normal to said beam longitudinal axis.

27. The framework of claim 18 including electrical wiring within a cavity defined by said beams and said posts, said electrical wiring being connectable to a power source at one of said posts and providing electricity to at least one outlet at each of said posts when connected to said power source.

28. The framework of claim 27 including at least one closure panel that substantially closes the V-shaped post to define a triangular-shaped post and to conceal said wiring therein.

29. The framework of claim 28, wherein at least one of said at least one closure panel comprises a translucent panel and wherein said post includes an illumination source therein, said illumination source being operable to back light said translucent panel.

30. A method of forming a display booth framework at a display area, said method comprising:

providing at least two posts, each of said posts comprising at least two post panels pivotally attached to one another and pivotable relative to one another along a post longitudinal axis;

providing at leas tone beam, said beam comprising at least two beam panels pivotally attached to one another and pivotable relative to one another along a beam longitudinal axis;

pivoting said post panels about said post longitudinal axis to position said post panels in an angled orientation to define an angled post;

pivoting said beam panels about said beam longitudinal axis to position said beam panels in an angled orientation to define an angled beam; and connecting each end of said angled beam to a respective one of said angled posts with a connector, said connector engaging a portion of said angled beam and engaging a portion of said angled post to connect said angled beam to said respective one of said angled posts.

31. The method of claim 30, wherein connecting each end of said angled beam comprises receiving an end portion of said panels of said angled beam in said connector to retain said beam panels in said angled orientation and connecting said connector to one of said post panels of said respective post.

32. The method of claim 31, wherein connecting said connector comprises lowering said connector into a receiving slot in said one of said post panels and rotating said connector to retain said connector in said receiving slot.

33. The method of claim 30 including a disassembling and storing said display booth framework, wherein disassembling and storing said display booth framework comprises:

removing said connector from said post panel;

pivoting said post panels about said longitudinal axis until said post panels are generally co-planar; and pivoting said post panels about a second axis that is generally normal to said longitudinal axis until said post panels are generally folded over onto one another.

34. The method of claim 33, wherein disassembling and storing said display booth framework comprises:

removing said connector from said beam panels;

pivoting said beam panels about said longitudinal axis until said beam panels are generally co-planar; and pivoting said beam panels about a second axis that is generally normal to said longitudinal axis until said beam panels are generally folded over onto one another.

* * * * *

UNITED STATES PATENT AND TRADEMARK OFFICE

CERTIFICATE OF CORRECTION

PATENT NO. : 7,140,307 B1
APPLICATION NO. : 10/767100
DATED : January 29, 2004
INVENTOR(S) : Paul A. Wolbert It is certified that error appears in the above-identified patent and that said Letters Patent is hereby corrected as shown below:

Column 1
Line 20, “booths,” should be --booths.--

Column 2
Line 30, “purpose” should be --purposes--
Line 66, “framework.” should be --framework;--

Column 3
Line 61, “32a-d” should be --34a-d--

Column 4
Line 42, “posts be” should be --posts can be--

Column 5
Line 6, “table” should be --tab--
Line 12, “48b is” should be --48b in--
Line 18, “locking of” should be --locking or--
Line 27, “22a or” should be --22a of--

Column 6
Line 45, “positioned” should be --position--
Line 63, “Notch 52” should be --Notch 51--
Line 64, “edge 52a” should be --edge 51a--
Line 65, “42” should be --52--

Column 8
Line 48, “ledges” should be --legs--
Line 48, “72a, 72b” should be --74a, 74b--
Line 65, “brackets” should be --bracket--

Column 9
Line 33, “faster” should be --fastener--

Column 10
Line 3, “test” should be --text--
Line 37, insert --or more-- after “mounted to one”
Line 54, “alternately” should be --alternatively--

UNITED STATES PATENT AND TRADEMARK OFFICE

CERTIFICATE OF CORRECTION

PATENT NO. : 7,140,307 B1
APPLICATION NO. : 10/767100
DATED : January 29, 2004
INVENTOR(S) : Paul A. Wolbert It is certified that error appears in the above-identified patent and that said Letters Patent is hereby corrected as shown below:

Column 11
Line 11, “components” should be --connectors--
Line 27, “Optionally” should be --Optional--

Column 12
Claim 12, Line 33, delete “reasonably securable to said horizontal beam, said sign holder” in 2nd instance Column 13
Claim 18, Line 14, insert --,-- after “at least one beam”
Claim 22, Line 42, “host” should be --slot--
Claim 26, Line 64, insert --together-- after “secured”

Column 14
Claim 30, Line 21, “at leas tone” should be --at least one--
Claim 33, Line 46, delete “a” after --including--

Signed and Sealed this

Twentieth Day of January, 2009

JON W. DUDAS
*Director of the United States Patent and Trademark Office*

UNITED STATES PATENT AND TRADEMARK OFFICE

CERTIFICATE OF CORRECTION

PATENT NO. : 7,140,307 B1
APPLICATION NO. : 10/767100
DATED : November 28, 2006
INVENTOR(S) : Paul A. Wolbert It is certified that error appears in the above-identified patent and that said Letters Patent is hereby corrected as shown below:

Column 1
Line 20, “booths,” should be --booths.--

Column 2
Line 30, “purpose” should be --purposes--
Line 66, “framework.” should be --framework;--

Column 3
Line 61, “32a-d” should be --34a-d--

Column 4
Line 42, “posts be” should be --posts can be--

Column 5
Line 6, “table” should be --tab--
Line 12, “48b is” should be --48b in--
Line 18, “locking of” should be --locking or--
Line 27, “22a or” should be --22a of--

Column 6
Line 45, “positioned” should be --position--
Line 63, “Notch 52” should be --Notch 51--
Line 64, “edge 52a” should be --edge 51a--
Line 65, “42” should be --52--

Column 8
Line 48, “ledges” should be --legs--
Line 48, “72a, 72b” should be --74a, 74b--
Line 65, “brackets” should be --bracket--

Column 9
Line 33, “faster” should be --fastener--

Column 10
Line 3, “test” should be --text--
Line 37, insert --or more-- after “mounted to one”
Line 54, “alternately” should be --alternatively--

UNITED STATES PATENT AND TRADEMARK OFFICE

CERTIFICATE OF CORRECTION

PATENT NO. : 7,140,307 B1
APPLICATION NO. : 10/767100
DATED : November 28, 2006
INVENTOR(S) : Paul A. Wolbert It is certified that error appears in the above-identified patent and that said Letters Patent is hereby corrected as shown below:

Column 11
Line 11, “components” should be --connectors--
Line 27, “Optionally” should be --Optional--

Column 12
Claim 12, Line 33, delete “reasonably securable to said horizontal beam, said sign holder” in 2nd instance Column 13
Claim 18, Line 14, insert --,-- after “at least one beam”
Claim 22, Line 42, “host” should be --slot--
Claim 26, Line 64, insert --together-- after “secured”

Column 14
Claim 30, Line 21, “at leas tone” should be --at least one--
Claim 33, Line 46, delete “a” after --including--

This certificate supersedes the Certificate of Correction issued January 20, 2009.

Signed and Sealed this

Seventeenth Day of February, 2009

John Doll

JOHN DOLL
*Acting Director of the United States Patent and Trademark Office*